US007988462B2

(12) United States Patent
Mao et al.

(10) Patent No.: US 7,988,462 B2
(45) Date of Patent: Aug. 2, 2011

(54) ELECTRICAL CONNECTOR HAVING HIGH DENSITY CONTACTS FOR MINIATURIZATION

(75) Inventors: Yu-Hua Mao, Kunshan (CN); Zhi-Hong Fang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/758,716

(22) Filed: Apr. 12, 2010

(65) Prior Publication Data

US 2011/0034088 A1 Feb. 10, 2011

(30) Foreign Application Priority Data

Aug. 10, 2009 (CN) ..... 2009 1 0305427

(51) Int. Cl.
*H01R 12/00* (2006.01)

(52) U.S. Cl. ..... 439/79

(58) Field of Classification Search ..... 439/79, 439/247

See application file for complete search history.

(56) References Cited

U.S. PATENT DOCUMENTS

| | | | | |
|---|---|---|---|---|
| 4,857,017 | A * | 8/1989 | Erk | 439/695 |
| 5,199,886 | A * | 4/1993 | Patterson | 439/79 |
| 5,672,064 | A * | 9/1997 | Provencher et al. | 439/79 |
| 5,676,554 | A * | 10/1997 | Tsuji | 439/79 |
| 6,908,317 | B2 * | 6/2005 | Li | 439/79 |
| 6,913,488 | B2 * | 7/2005 | Motojima et al. | 439/607.01 |
| 7,537,465 | B2 * | 5/2009 | Fang et al. | 439/79 |

* cited by examiner

*Primary Examiner* — Briggitte R Hammond
(74) *Attorney, Agent, or Firm* — Wei Te Chung; Andrew C. Cheng; Ming Chieh Chang

(57) ABSTRACT

An electrical connector includes an insulative housing (1) with a rear portion (11) and a front portion (12) along a first direction (A), a spacer (4) assembled on the rear portion (11) which has a plurality of first wedged positioning sections (42, 43) in an inner side thereof and arranged along a second direction (B) and a plurality of contacts (2) received in the insulative housing and comprising a soldering portion (203) extending out of the insulative housing. The spacer (4) includes a plurality of positioning grooves (45) in an external side thereof for receiving and positioning the soldering portions (203*c*) of one part contacts (23) located at an upper side of the front portion (12). The soldering portions (203*a*, 203*b*) of the other contacts (21*a*, 21*b*) are sandwiched between the spacer (4) and the rear portion (11) thereby forms a waved configuration.

20 Claims, 9 Drawing Sheets

ELECTRICAL CONNECTOR HAVING HIGH DENSITY CONTACTS FOR MINIATURIZATION

This application is related to so and so U.S. patent application Ser. No. 12/755,383, filed Apr. 6, 2010, entitled "LOW PROFILE CONNECTOR WITH COMBO SOLDER TAILS", and which is assigned to the common assignee, and is incorporated herewith for reference.

BACKGROUND OF THE INVENTION

1. Field of the Invention

The present invention relates to an electrical connector having a plurality of high density contacts for miniaturization.

2. Description of the Related Art

U.S. Pat. No. 7,537,465 issued to Mao et. al on May 26, 2009, discloses an electrical connector including an insulative housing, a plurality of contact units arranged in the insulative housing along a horizontal direction, a shielding shell covering on the insulative housing and a spacer assembled with the insulative housing. The insulating housing defines a front end portion and a rear end portion having a first wedged positioning section. The contact includes a tail portion extending out of the rear end portion of the insulative housing. The spacer has a second wedged positioning section corresponding to and engaging with the rear end portion of the insulative housing thereby forming a positioning device for sandwiching the tail portion of the contact therein. So the contacts are retained between the rear end portion of the insulating housing and the spacer.

With development of electronics technology, the numbers of the contacts need to be increased and then the size of the spacer in the horizontal direction would be changed to become more bigger than before if the contacts are arranged on the spacer in original pitch. On the contrary, the interval between the two adjacent contacts is required to be smaller and smaller if the original pitch is decreased to keep the original size of electrical connector, so it would generate electronic magnetic interference between adjacent contacts.

Therefore, an improved electrical connector is desired to overcome the disadvantages of the related arts.

SUMMARY OF THE INVENTION

An object of the present invention is to provide a miniaturize electrical connector having a plurality of high density contacts, but being able to transmit a high quality signal.

In order to achieve above-mentioned object, an electrical connector in accordance with a preferred embodiment of the present invention includes an insulative housing with a rear portion and a front portion along a first direction, a spacer assembled on the rear portion which has a plurality of first wedged positioning sections in an inner side thereof and arranged along a second direction and a plurality of contacts received in the insulative housing and comprising a soldering portion extending out of the insulative housing. The spacer includes a plurality of positioning grooves in an external side thereof for receiving and positioning the soldering portions of one part contacts located at an upper side of the front portion. The soldering portions of the other contacts are sandwiched between the spacer and the rear portion thereby forms a waved configuration.

Other objects, advantages and novel features of the invention will become more apparent from the following detailed description of the present embodiment when taken in conjunction with the accompanying drawings.

DETAILED DESCRIPTION OF THE INVENTION

Figure 1:
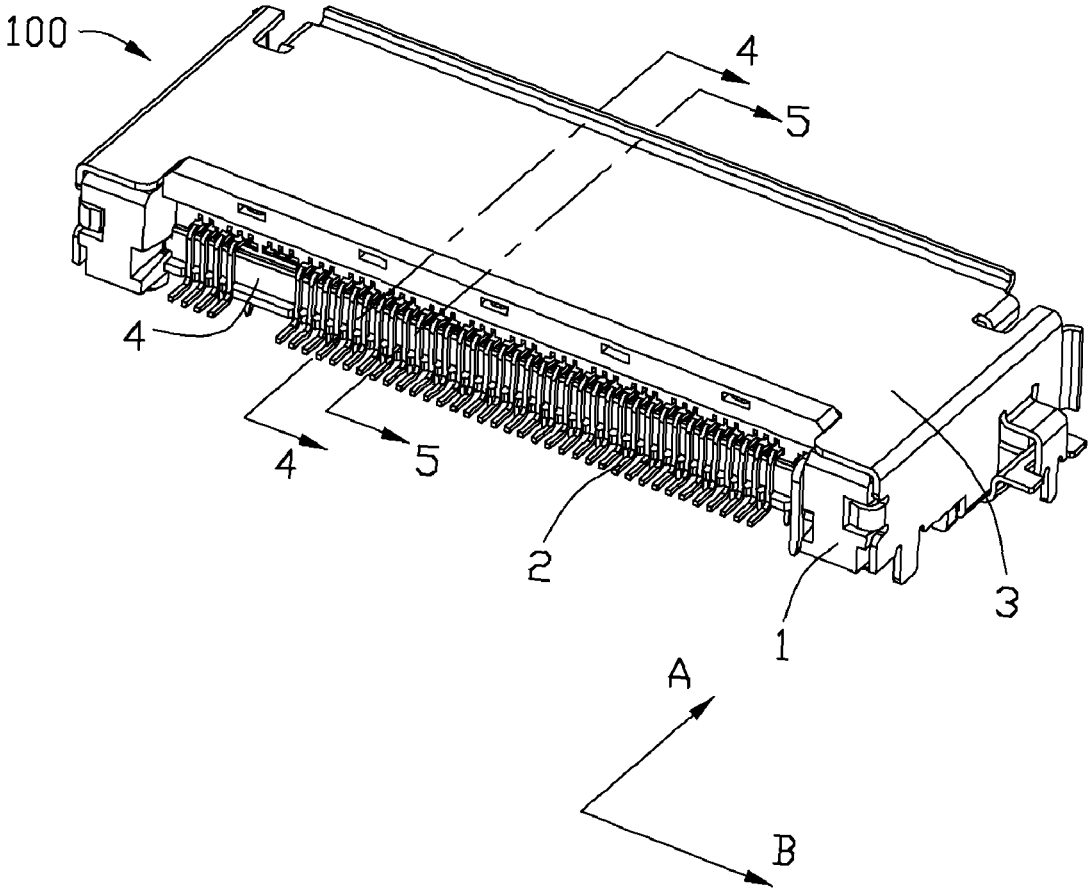
FIG. 1 is a perspective view of an electrical connector in accordance with the preferred embodiment of the present invention.

Reference will now be made to the drawing figures to describe the preferred embodiment of the present invention in detail.

Figure 2:
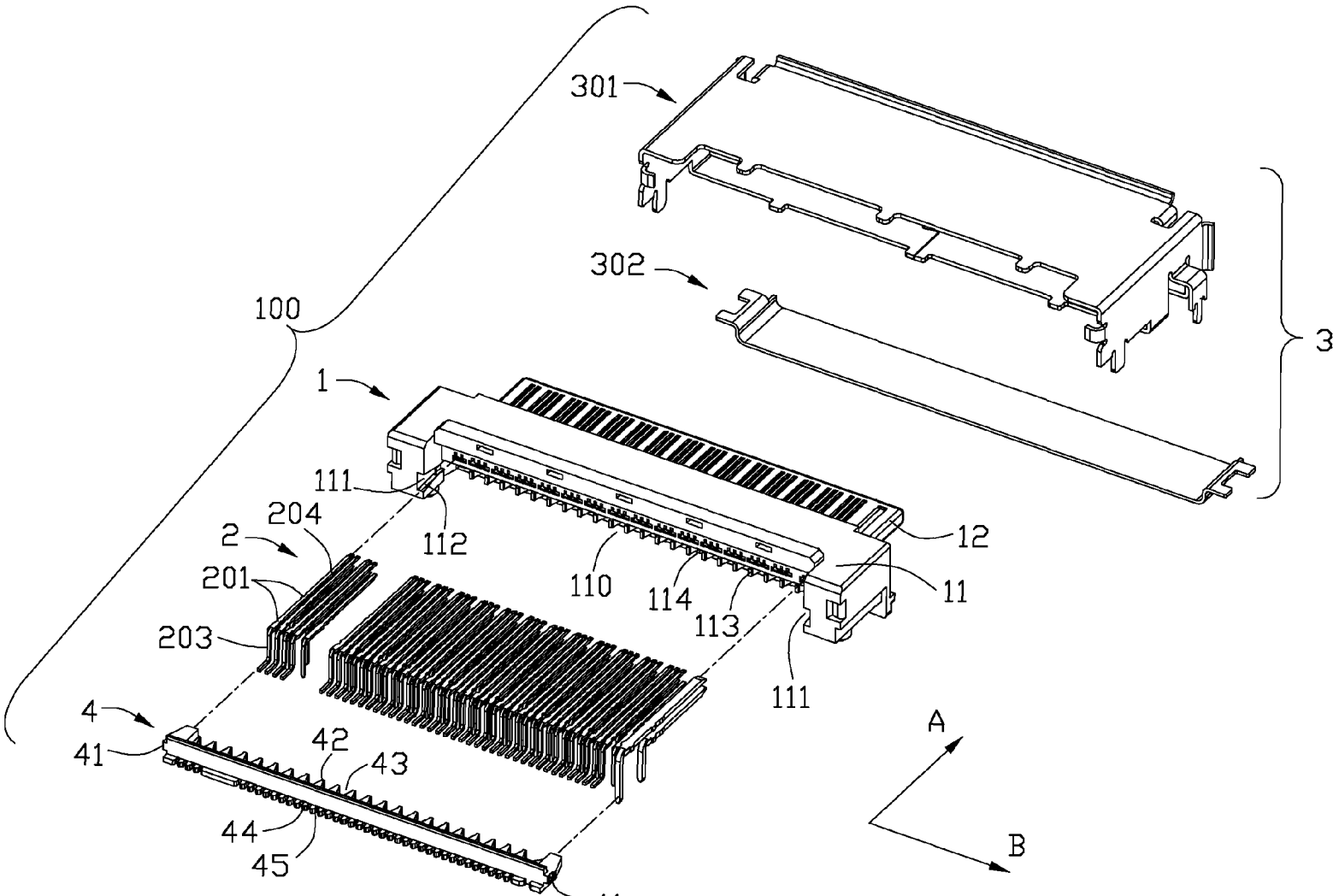
FIG. 2 is an exploded perspective view of the electrical connector of FIG. 1.

Referring to FIGS. 1 and 2, an electrical connector 100 in accordance with the present invention includes an insulative housing 1 with a rear portion 11 regarded as a base portion and a front portion 12 regarded as an engaging portion along a first direction, i.e. direction A, a plurality of contacts 2 received in the insulative housing and arranged along a second direction, i.e. direction B, a metallic shell 3 and a spacer 4 assembled on the base portion 11 of the insulative housing 1. The metallic shell 3 includes a top shell 301 and a bottom shell 302 thereby surrounding and covering on the housing 10 for providing a perfect shielding with a simple structure.

Figure 3:
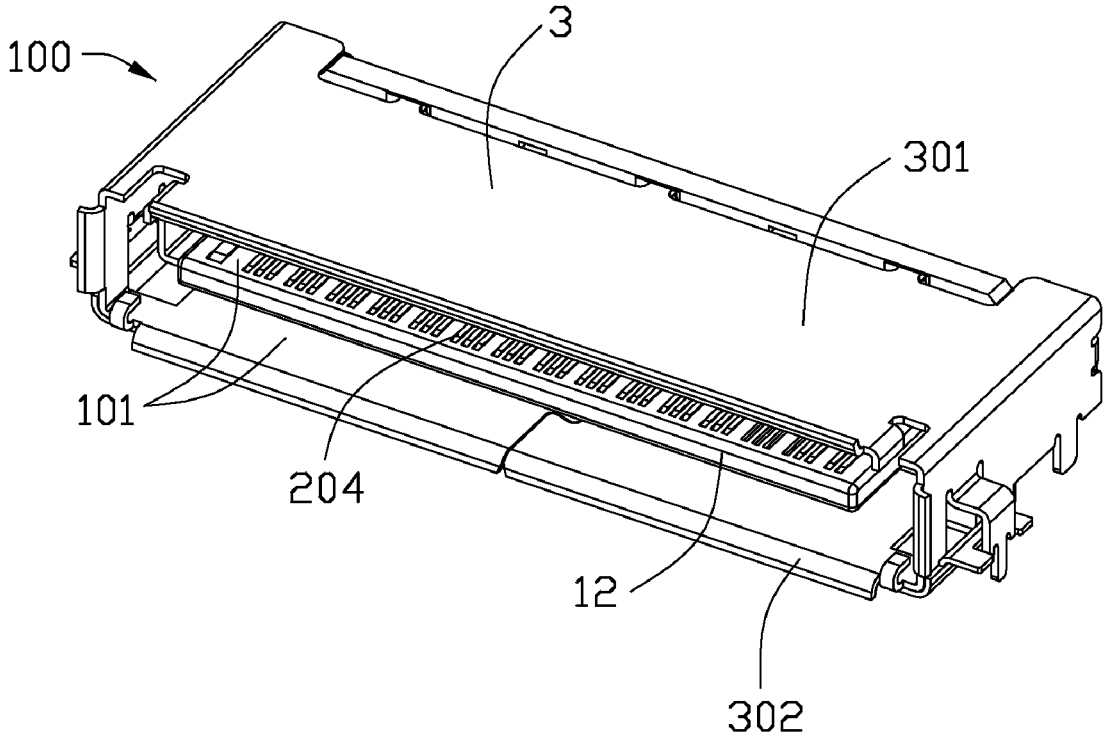
FIG. 3 is another perspective view of the electrical connector of FIG. 1 viewed from a front view.
Figure 4:
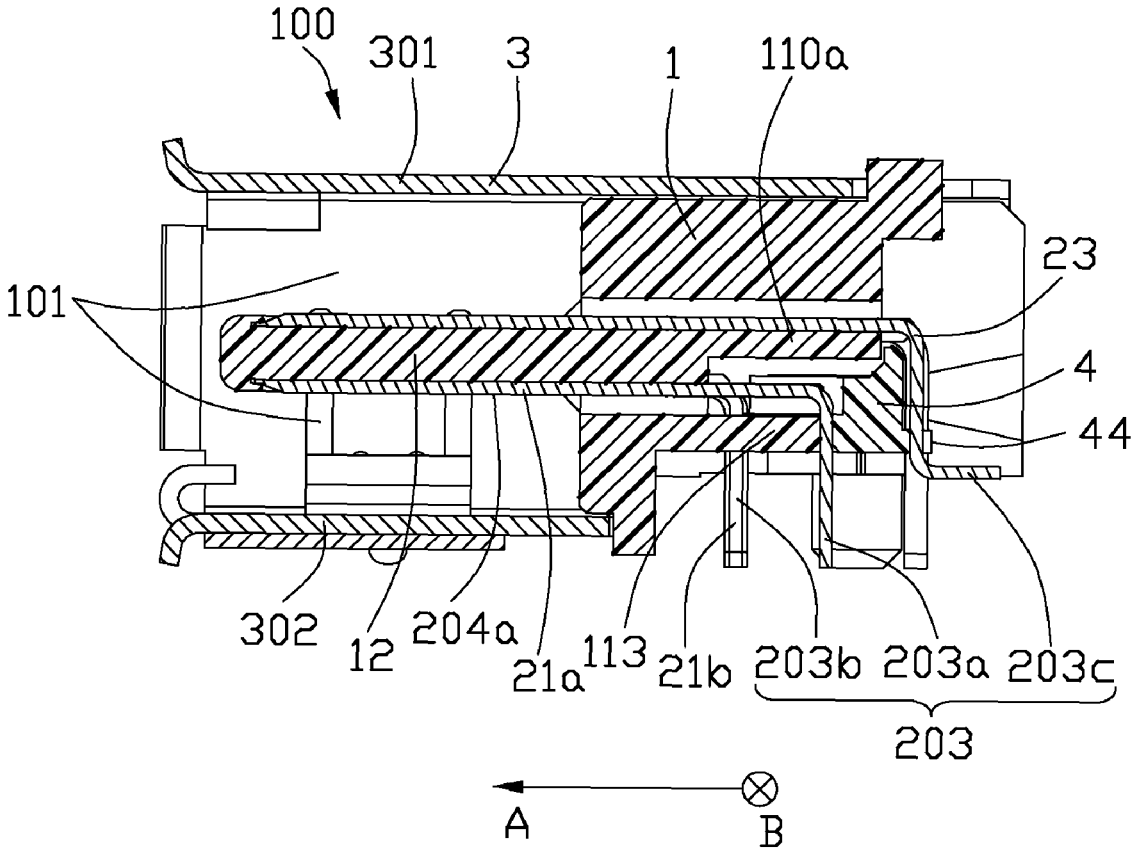
FIG. 4 is a cross-section view of the electrical connector taken along line 4-4 of FIG. 1.

Referring to FIGS. 2, 3 and 4, the engaging portion 12 of the insulative housing 1 is a tongue shape configuration and surrounded by the shell 3 thereby forming a mating space 101 for receiving and mating with a mating connector (not shown). The base portion 11 forms a receiving slot 110 for receiving the spacer 4 and a protecting portion 110*a* for preventing the spacer 4 from moving upwards. Each of the contact 2 are inserted into the insulative housing along the direction A and includes a retaining portion 201 retained in the base portion 11, said soldering portion 203 extending out of the base portion 11 from one end of the retaining portion 201 and a contacting portion 204 extended into the mating space 101 for electrically connecting with the mating connector.

Figure 5:
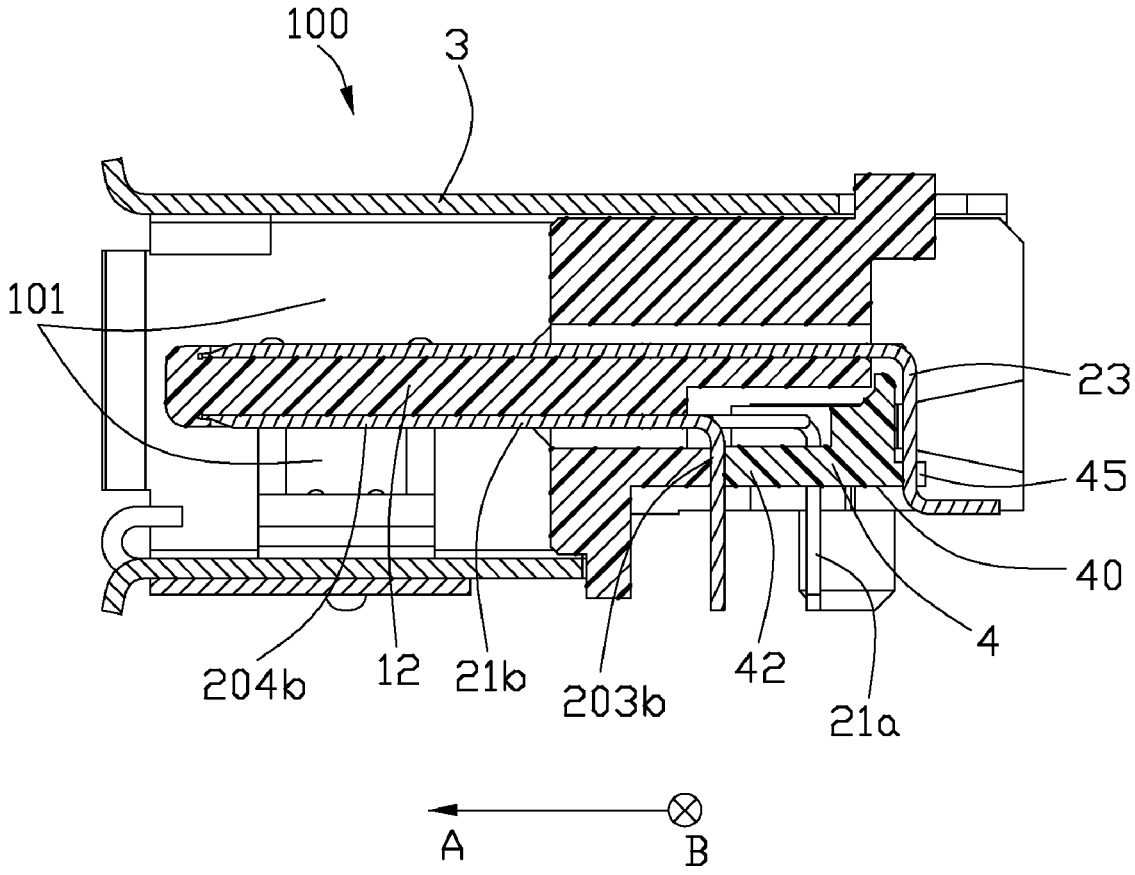
FIG. 5 is a cross-section view of the electrical connector taken along line 5-5 of FIG. 1.
Figure 6:
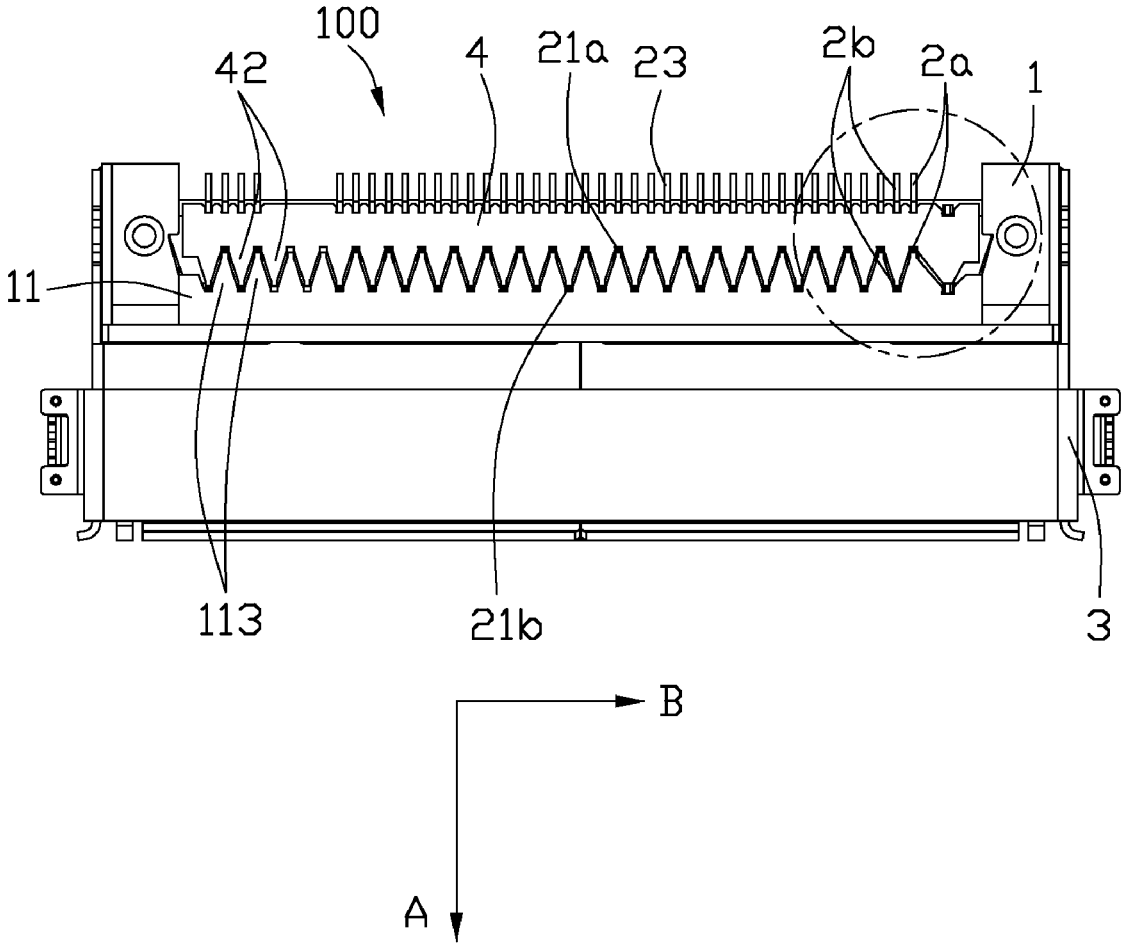
FIG. 6 is a bottom plan view of the electrical connector of FIG. 1.

Referring to FIGS. 4, 5 and 6, the contacts 2 are respectively arranged in an upper side and a lower side of the engaging portion 12. Further more, a plurality of first contacts 21*a* and a plurality of second contacts 21*b* are located at the lower side of the engaging portion 12 and opposite to the bottom shell 302. A first contacting portion 204*a* of the first contact 21 and a second contacting portion 204*b* of the second contact 21*b* are coplanar, while the soldering portions 203*a*, 203*b* thereof are perpendicular to a mounting surface (not shown) of the electrical connector 100. While a plurality of third contact 23 are disposed on an upper side of the engaging portion 12 and opposite to the top shell 301. The soldering portions 203*c* of the third contacts 23 are arranged along the direction B in a row while the soldering portions 203 thereof are parallel to said mounting surface for soldered onto a corresponding PCB (not shown) as a surface mounting technology (SMT) manner.

Figure 7:
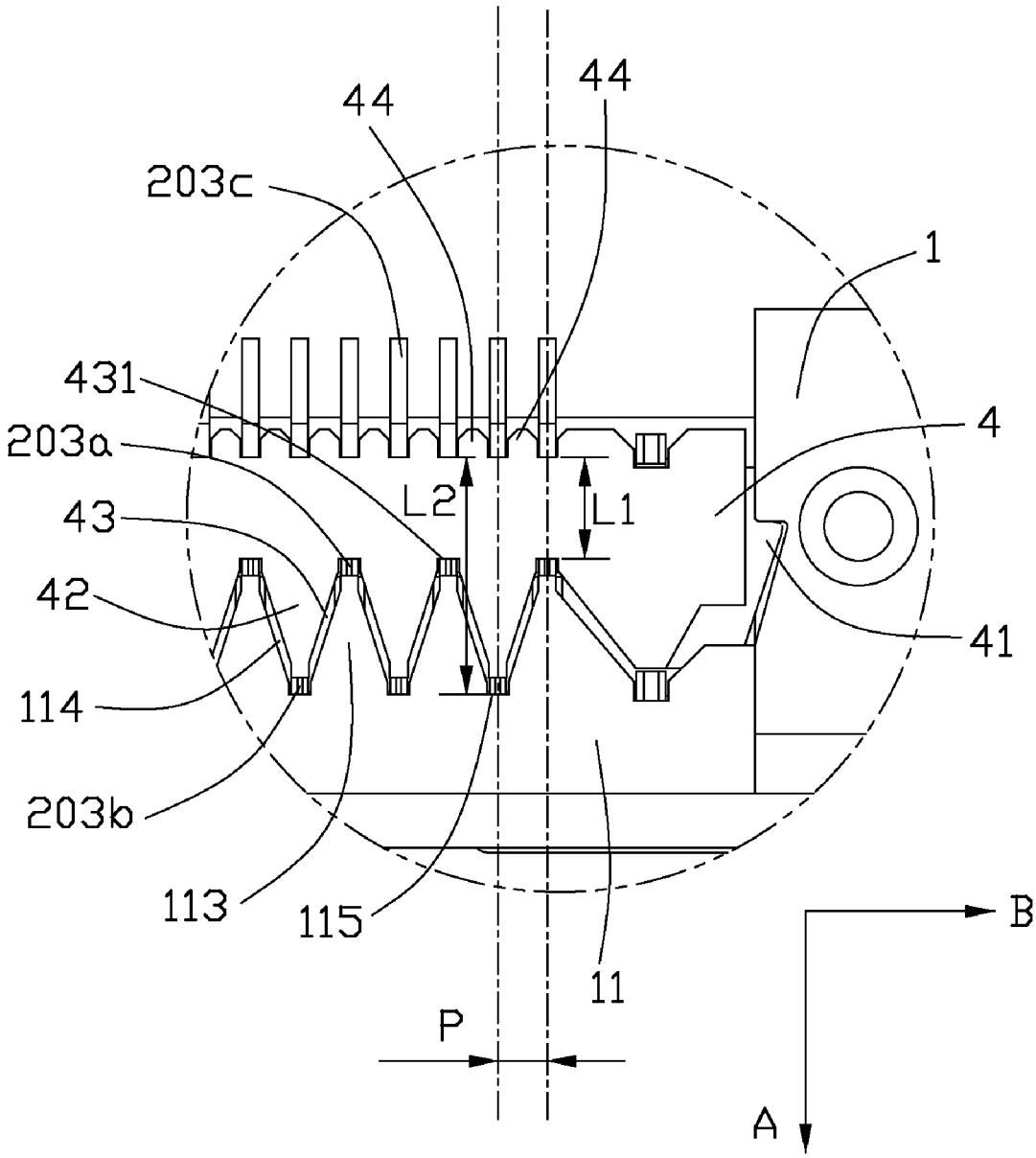
FIG. 7 is a partial enlarged view of the electrical connector of FIG. 6.

Cooperation with FIGS. 2, 6 and 7, the base portion 11 defines a plurality of second wedged protruding portions 113 and a plurality of second wedged recessed portion 114 between the two adjacent second wedged protruding portions 113 along direction B thereby forms a second wedged positioning sections. The soldering portions 203*a* of the first contacts 21*a* are disposed and pre-positioned on a top of the second wedged protruding portions 113 and arranged in a row along the direction A. While the soldering portions 203*b* of the second contacts 21*b* are received and pre-positioned in the wedged recessed portion 114 and arranged in another row along the direction A. The soldering portions 203*a*, 203*b* are parallel to and alternated with each other, thereby forms a waved configuration.

The spacer 4 forms a plurality of first wedged protruding portions 42 and a first recessed portion 43 along direction B for respectively engaging with the second wedged recessed portion 114 and the second wedged protruding portions 113, thereby forms a first wedged positioning sections. The spacer 4 also includes a plurality of protruding portions 44 and a plurality of positioning grooves 45 formed therebetween at a rear side of the spacer 4 opposite to the first wedged positioning sections 42 thereof. The base portion 11 of the insulative housing 1 has a pair of slots 111 for receiving a pair of fitting portions 41 defined by both ends of the spacer 4 and two guiding surfaces 112 formed at an opening of the slot 111 for guiding the spacer 4 inserted into the insulative housing 1.

The spacer 4 is inserted into the receiving slot 110 of the base portion 11 and then blocked in the slot 111 when the first contact 21*a* and the second contact 21*b* are assembled into the insulative housing 1. So the soldering portions 203*a*, 203*b* are respectively sandwiched between the first wedged positioning section 43, 42 of the spacer 4 and the second wedged positioning sections 113, 114 of the base portion 11. The distance between the first contact 21*a* and the second contact 21*b* is added for prevent the contacts 2 from cross-talk. The third contacts 23 are inserted into after the spacer 4 assembled onto the insulative housing 1. Therefore the soldering portions 203*c* of the third contacts 23 are positioned between of two adjacent protruding portions 44 and received in the positioning grooves 45 of the spacer 4. As a result, the soldering portions 203 of the contacts 2 are divided into pre-mentioned three rows and then it is benefit for increasing a length of the electrical connector 100 in the direction B.

Figure 8:
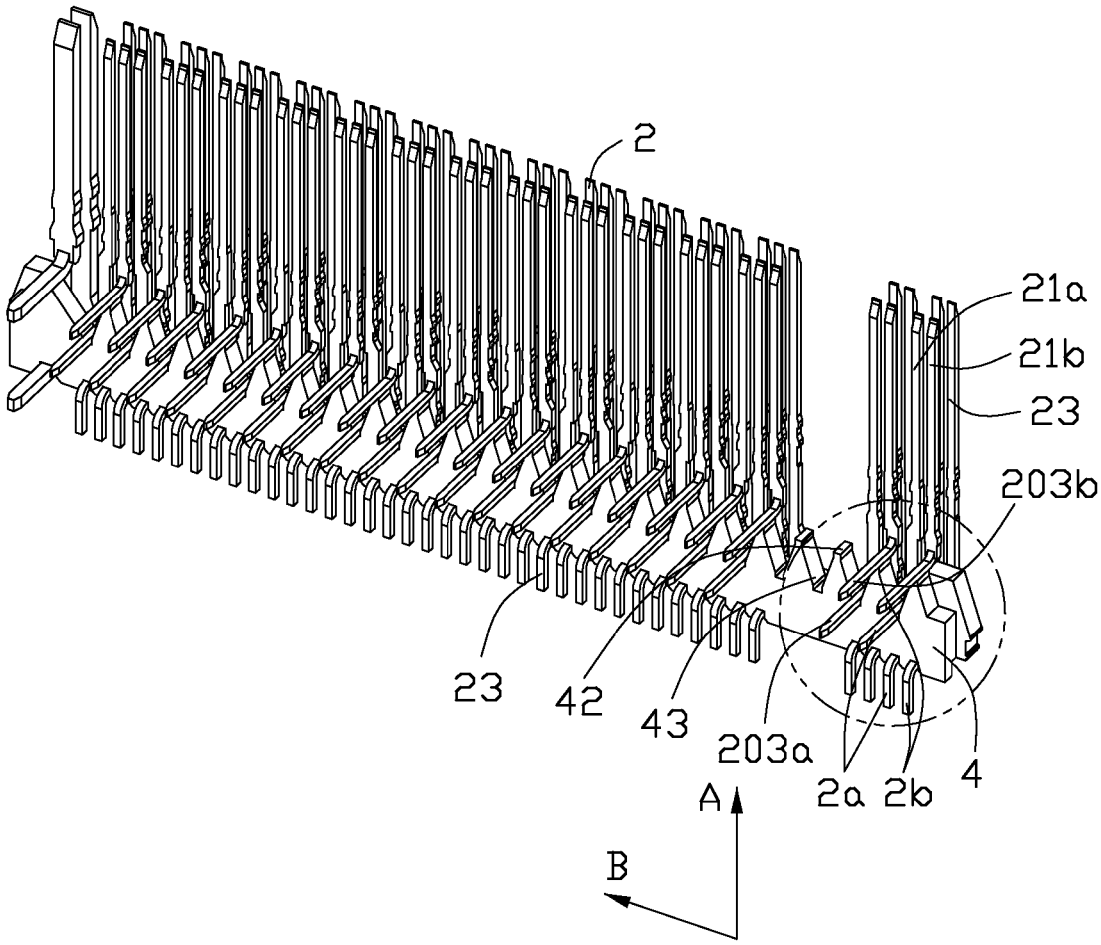
FIG. 8 is a perspective view of a spacer and a plurality of contacts assembled with the spacer of FIG. 2.
Figure 9:
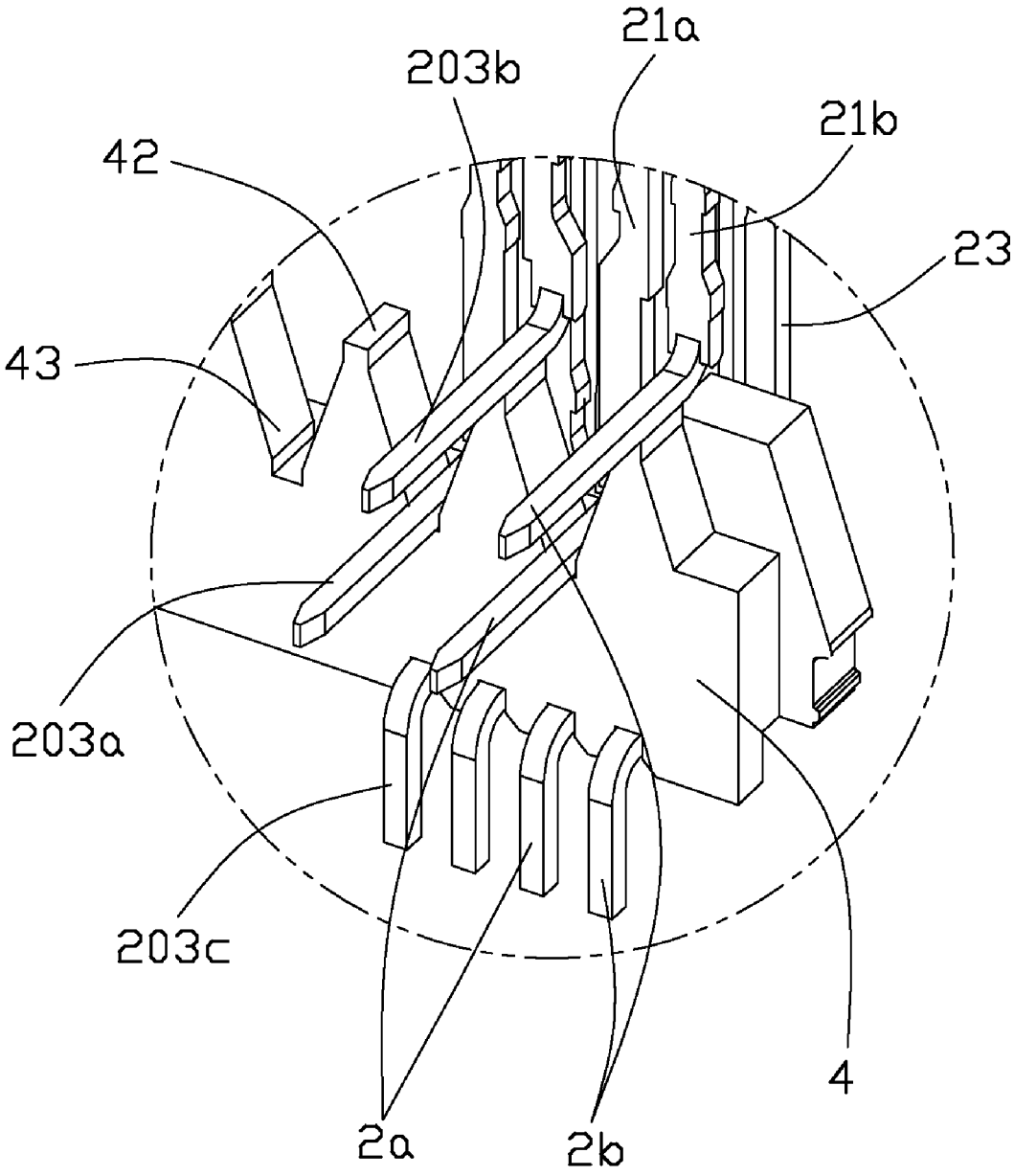
FIG. 9 is a partial enlarged view of the electrical connector of FIG. 8.

Referring to FIGS. 7, 8 and 9, the first contact 21*a* and the third contact 23 in alignment with each other in the direction A can be regarded as a first contact unit 2*a*, while the second contact 21*b* and the third contact 23 in alignment with each other in the direction A can be regarded as a second contact unit 2*b*. The first contact units 2*a* and the second contact units 2*b* are alternately arranged in an interval P along Direction B. A distance L1 between of the two soldering portions 203*a*, 203*c* is smaller than a distance L2 between of the two soldering portions 203*b*, 203*c* in the direction A, i.e. the soldering portion 203*a* of the first contact 21*a* is closer to the soldering portion 203*c* of the third contact 23 than the soldering portion 203*b* of the second contact 21*b*. In this structure, it is benefit for preventing the contacts 2 from cross-talk and reducing the size of the electrical connector 100.

The spacer 4 defines an inner positioning area which is formed by the plurality of wedged positioning sections 42, 43 for cooperation with the base portion 11 of the insulative housing 10, and an external positioning area defined by the positioning grooves 45 at external side thereof, thereby the spacer 4 forms a positioning device for receiving and retaining the soldering portions 203 of the contacts 2. So the first contacts 21*a* and the second contacts 21*b* are positioned at the inner side of the spacer 4. The third contacts 23 are positioned at the external side of the spacer 4 as of the limited of the soldering portion 203*c*. The spacer 4 has a bottom side 40 parallel to the pre-mentioned mounting surface and the positioning grooves 45 thereof are perpendicular to and closed to the bottom side 40 for steadily fixing a footer of the soldering portion 203 of the third contact 23 (see FIG. 5). The base portion 11 forms a receiving recess 115 in bottom of the second recessed portion 114 for pre-position of and receiving the second contact 21*b*. The spacer 4 defines another receiving recess 431 similar to said receiving recess 115 and formed in the first recessed portion 43 for receiving and positioning the first contact 21*a*.

It is noted that the compliant engagement between the first wedged positioning sections 42/43 and the second wedged positioning sections 113/114 essentially requires a relatively large pitch between the neighboring soldering portions 203*a*, 203*b*. Therefore, the contacts 2 define the contacting portions 204*a*, 204*b* with the relatively small pitch in comparison with the soldering portions. If there is no increase of the pitch arrangement on the soldering portions 203*a*, 203*b*, the first wedged positioning sections 42/43 and the second wedged positioning sections 113/114 may be formed relative tiny with less strength thereof with inoperability issue. In fact, as disclosed in U.S. Pat. No. 7,537,465, the structure of the first wedged positioning sections and of the second wedged positioning sections is previously used with the contacts having two rows of contacting portions and two rows of soldering portions rather than one row of contacting portions and two rows of soldering portions. By means of the arrangement disposed in the invention, more flexibility and variety of the arrangement of the contacting portions and the soldering portions of the contacts may be obtained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing comprising a rear portion and a front portion along a first direction;

a spacer assembled on the rear portion of the insulative housing and comprising a plurality of first wedged positioning sections in an inner side thereof and arranged along a second direction perpendicular to the first direction, the first wedged positioning sections defining a row of first wedged slots and a row of first wedged peaks in alignment with the row first wedged slots in the second direction;

a plurality of contacts received in the insulative housing and comprising a soldering portion extending out of the insulative housing and arranged in at least three rows;

wherein a first row of soldering portions are received in a bottom of the first wedged slots of the spacer, a second row of soldering portions are disposed on a top of the first wedged peaks of the spacer thereby forming a wave configuration in combining with the first row of soldering portions, furthermore a third row of soldering portions are received and positioned in a plurality of positioning grooves formed by a rear side of the spacer.

2. The electrical connector as described in claim 1, wherein the first row of soldering portions and second row of soldering portions are disposed at lower side of the front portion and perpendicular to a mounting surface of the electrical connector.

3. The electrical connector as described in claim 2, wherein the contacts located an upper side of the front portion comprises a soldering portion parallel to a mounting surface of the electrical connector.

4. The electrical connector as described in claim 3, wherein the soldering portions of the contacts located at an upper side of the front portion are arranged in a row along the second direction and parallel to each other.

5. The electrical connector as described in claim 4, wherein the spacer comprises a bottom side parallel to the mounting surface and the positioning grooves thereof are perpendicular to and closed to bottom side of the spacer.

6. The electrical connector as described in claim 2, wherein the soldering portions of the contacts disposed at a lower side of the front portion are arranged in two rows along the second direction which are parallel to each other.

7. An interconnection system with a positioning spacer comprising:

an insulative housing comprising a base portion and an engaging portion extending from the base portion along a first direction;

a plurality of first contact units and a plurality of second contact units alternately arranged in a predetermine interval along a second direction perpendicular to the first direction, each of said contact units comprising a pair of contacts with soldering portions in alignment with each other along the first direction;

the positioning spacer comprising a plurality of first wedged peaks and a plurality of first wedged slots each of which is formed by said two adjacent first wedged peaks, the positioning spacer assembled with the base portion of the insulative housing and pressed against the first contact units and second contact units;

a first distance between of two soldering portions of each first contact unit is smaller than a second distance between of two soldering portions of each second contact unit in the first direction; and wherein the first contact units defining a first row of soldering portions received in a bottom of the first wedged slots of the spacer and the second contact units defining a second row of soldering portions disposed on a top of the first wedged peaks of the spacer and paralleling to the first row of soldering portions.

8. The interconnection system with a positioning spacer as described in claim 7, wherein the positioning spacer comprises an inner positioning area which is formed by a plurality of wedged positioning sections for cooperation with the base portion and an external positioning area is formed by a plurality of positioning grooves at an external side thereof.

9. The interconnection system with a positioning spacer as described in claim 8, wherein the first contact unit comprises a first contact disposed at a lower side of the engaging portion and a third contact disposed at an upper side of the engaging portion.

10. The interconnection system with a positioning spacer as described in claim 9, wherein the second contact unit comprises a second contact disposed at a lower side of the engaging portion and a third contact disposed at an upper side of the engaging portion.

11. The interconnection system with a positioning spacer as described in claim 10, wherein the soldering portions of the third contacts are arranged in a row along the second direction.

12. The interconnection system with a positioning spacer as described in claim 10, wherein the soldering portions of the first contact and the second contacts form a waved configuration along the second direction.

13. An interconnection system comprising:

an insulative housing defining thereof a rear portion and a front portion along a first direction;

a plurality of first contacts disposed in the housing, each of said first contacts defining a mating portion extending into the front portion of the housing and a soldering portion extending out of the rear portion of the housing under condition that the mating sections are arranged in one row while the soldering portions are arranged alternately in two rows; and a spacer assembled unto the rear portion of the housing and including a plurality of first wedged positioning sections located on a front side thereof along a second direction perpendicular to said first direction; wherein said first wedges positioning sections commonly define a series of peak-valley structures along the second direction with equal intervals thereof so as to confront the alternately arranged soldering portions with a first pitch thereof in said second direction, while the mating portions are arranged with a plurality of groups and each group defines a second pitch smaller than the first pitch in said second direction.

14. The interconnection system as claimed in claim 13, further including a plurality of second contacts having corresponding contacting sections in another row parallel to the mating portions of the first contacts and having corresponding soldering sections behind the soldering portions of the first contacts, wherein a plurality of grooves are formed in the rear side of the space to respectively receive said soldering sections of the second contacts.

15. The interconnection system as claimed in claim 14, wherein said soldering sections are arranged in one row and said grooves are arranged in one row corresponding to the row soldering sections.

16. The interconnection system as claimed in claim 15, wherein said soldering sections include horizontal sections for surface mounting to a printed circuit board.

17. The interconnection system as claimed in claim 16, wherein said soldering portions of the first contacts define vertical sections for extending through the printed circuit board.

18. The interconnection system as claimed in claim 17, wherein the rear portion of the housing defines a plurality of second wedged positioning sections compliantly matching said plurality of first wedged positioning sections, respectively.

19. The interconnection system as claimed in claim 18, wherein there are three first contacts in each group, and each of said three first contacts has respective retention structure different from that of others.

20. The interconnection system as claimed in claim 19, wherein said three first contacts includes two side ones and a middle one under condition that each of said two side ones defines the retention structure on an outer side while the middle one defines the retention structure on both sides.

* * * * *